US007349193B2

(12) United States Patent
Cheever, Jr.

(10) Patent No.: US 7,349,193 B2
(45) Date of Patent: Mar. 25, 2008

(54) SOLENOID DRIVER WITH HIGH-VOLTAGE BOOST AND REVERSE CURRENT CAPABILITY

(75) Inventor: Gordon D. Cheever, Jr., Peru, IN (US)

(73) Assignee: Delphi Technologies, Inc., Troy, MI (US)

( * ) Notice: Subject to any disclaimer, the term of this patent is extended or adjusted under 35 U.S.C. 154(b) by 67 days.

(21) Appl. No.: 11/114,594

(22) Filed: Apr. 26, 2005

(65) Prior Publication Data

US 2006/0238949 A1 Oct. 26, 2006

(51) Int. Cl.
*H01H 47/04* (2006.01)
*H01H 47/32* (2006.01)

(52) U.S. Cl. ..... 361/155; 361/154; 361/156

(58) Field of Classification Search ..... 361/155, 361/154, 156
See application file for complete search history.

(56) References Cited

U.S. PATENT DOCUMENTS 3,097,777 A * 7/1963 Floyd ..... 226/39
5,717,562 A * 2/1998 Antone et al. ..... 361/155
6,175,484 B1 * 1/2001 Caruthers et al. ..... 361/159

OTHER PUBLICATIONS

Wiley Encyclopedia of Electrical and Electronics Engineering, 1999, John Wiley & Sons, Inc., vol. 6, 137-141.*

* cited by examiner

*Primary Examiner*—Michael Sherry
*Assistant Examiner*—Zeev Kitov
(74) *Attorney, Agent, or Firm*—Jimmy L. Funke

(57) ABSTRACT

Prior to the operation of a solenoid type of fuel injector, a DC voltage is applied across the injector to create a current through the injector that is below the activation current of the injector. A capacitor is then placed in series with the injector and the flyback energy from the injector transfers a charge onto the capacitor. When the injector current drops to a predetermined level, the capacitor is removed from the circuit and isolated. This process is repeated until a minimum charge is on the capacitor. By placing the capacitor charge onto the injector at the time that the injector is to be activated, the opening response of the injector is improved. By applying the charge on the capacitor to the injector in a manner to neutralize the eddy currents when the voltage across the injector is removed, the closing response is improved.

4 Claims, 7 Drawing Sheets

SOLENOID DRIVER WITH HIGH-VOLTAGE BOOST AND REVERSE CURRENT CAPABILITY

TECHNICAL FIELD

The present invention relates to the art of the electronic control of the solenoid in a fuel injector in an internal combustion engine.

BACKGROUND OF THE INVENTION

The accurate control of the activation and deactivation of solenoids in fuel injectors in internal combustion engines is of importance since the operational characteristics of the fuel injector affect the efficiency of the engine. While fuel injectors have traditionally been driven by the battery voltage in a vehicle, a higher voltage has been used in the prior art to improve the rise time characteristics of the current through a fuel injector. Still, it is desirable to further improve the performance of a fuel injector.

Therefore, it is a primary object of the invention to improve the performance of a fuel injector.

SUMMARY OF THE INVENTION

Briefly described, a method of operating a solenoid includes applying a voltage across the solenoid so that a current of a first magnitude flows through the solenoid. The voltage across the solenoid is stopped and the flyback energy in the solenoid is routed to a capacitor such that charge is transferred to the capacitor until the current through the solenoid falls to a second magnitude. The voltage is reapplied at the same time that the capacitor is isolated from the solenoid until the current through the solenoid again reaches the first magnitude at which time the voltage is interrupted and the flyback energy is used to further charge the capacitor. The voltage on the capacitor is applied across the solenoid such that the current through the solenoid reaches a third magnitude.

BRIEF DESCRIPTION OF THE DRAWINGS

The present invention will now be described, by way of example, with reference to the accompanying drawings, in which.

Figure 1:
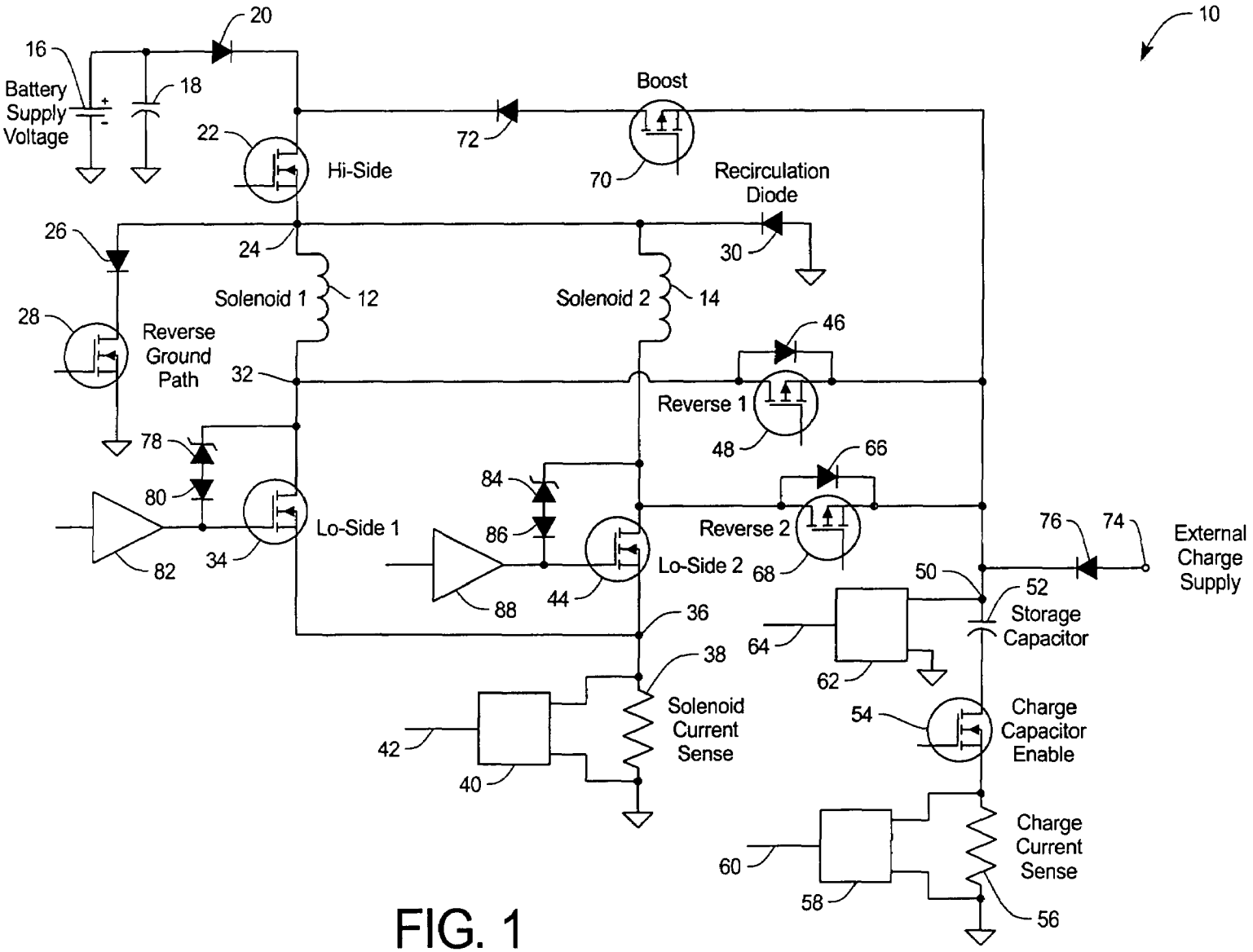
FIG. 1 is a schematic diagram of a fuel injector control circuit according to the present invention.

It will be appreciated that for purposes of clarity and where deemed appropriate, reference numerals have often been repeated in the figures to indicate corresponding features, and that the various elements in the drawings have not necessarily been drawn to scale in order to better show the features of the invention.

DESCRIPTION OF THE PREFERRED EMBODIMENTS

FIG. 1 is a schematic diagram of a fuel injector control circuit 10 according to the present invention. The diagram 10 shows a first solenoid, such as a fuel injector, 12, labeled "Solenoid 1" in FIG. 1, and a second solenoid, such as a fuel injector, 14, labeled "Solenoid 2." Battery voltage 16, labeled "Battery Supply Voltage," placed in parallel with a voltage stabilizing capacitor 18, is coupled through the anode-to-cathode junction of a diode 20 and an n-channel transistor 22, labeled "Hi-Side," to a node 24. Node 24 is connected to the upper terminals of the injectors 12 and 14, and coupled to chassis ground through the anode-to-cathode junction of another diode 26 and another n-channel transistor 28, labeled "Reverse Ground Path." A third diode 30, labeled "Recirculation Diode," couples node 24, connected to the cathode of the diode 30, to chassis ground.

The lower terminal of injector 12 at a node 32 is coupled through another n-channel transistor 34, labeled "Lo-Side 1," to a node 36 which, in turn, is coupled to chassis ground through a solenoid current sensing resistor 38, labeled "Solenoid Current Sense." Voltage amplifier 40 provides an output signal at terminal 42 indicative of the current through the current sensing resistor 38. Node 32 is also coupled through the anode-to-cathode junction of a diode 46, that is in parallel with the drain and source of a p-channel transistor 48, labeled "Reverse 1," to a node 50 that, in turn, is coupled through a storage capacitor 52, labeled "Storage Capacitor," an n-channel transistor 54, labeled "Charge Capacitor Enable," and a charge current sensing resistor 56, labeled "Charge Current Sense," to chassis ground. Voltage amplifier 58 provides a signal at terminal 60 indicative of the current through the charge current sensing resistor 56. A third voltage amplifier 62, having one input connected to node 50 and the other input connected to chassis ground, provides an output signal at terminal 64 indicative of the voltage at node 50.

The lower terminal of injector 14 is coupled through another n-channel transistor 44, labeled "Lo-Side 2," to the node 36. The lower terminal of injector 14 is also coupled through the anode-to-cathode junction of a diode 66, that is in parallel with the drain and source of a p-channel transistor 68, labeled "Reverse 2," to the node 50. The node 50 is coupled through a p-channel transistor 70, labeled "Boost," and the anode-to-cathode junction of a diode 72 to the junction of the diode 20 and the n-channel transistor 22. Diodes 46 and 66 are used because they have better forward bias and switching characteristics than the intrinsic diodes of the transistors 48 and 68, but could be eliminated if the intrinsic diodes of the transistors 48 and 68 have acceptable forward bias and switching characteristics.

An external high voltage can be connected at terminal 74, labeled "External Charge Supply," which, in turn, is coupled to node 50 through the anode-to-cathode junction of a diode 76.

Transistor 34 has its drain coupled to its gate by the series combination of a cathode-to-anode junction of a zener diode 78 and an anode-to-cathode junction of a diode 80. The gate of transistor 34 is driven by a FET driver circuit 82.

Similarly, n-channel transistor 44 has its drain coupled to its gate by the series combination of a cathode-to-anode junction of a zener diode 84 and an anode-to-cathode junction of a diode 86, and the gate of transistor 44 is driven by a FET driver circuit 88.

It will be understood that the circuit 10 of FIG. 1 is arranged to drive the two injectors 12 and 14 in the same manner but not at the same time. Although two injectors are shown in FIG. 1, any number of injectors can be included in the circuit 10 of FIG. 1.

Figure 2:
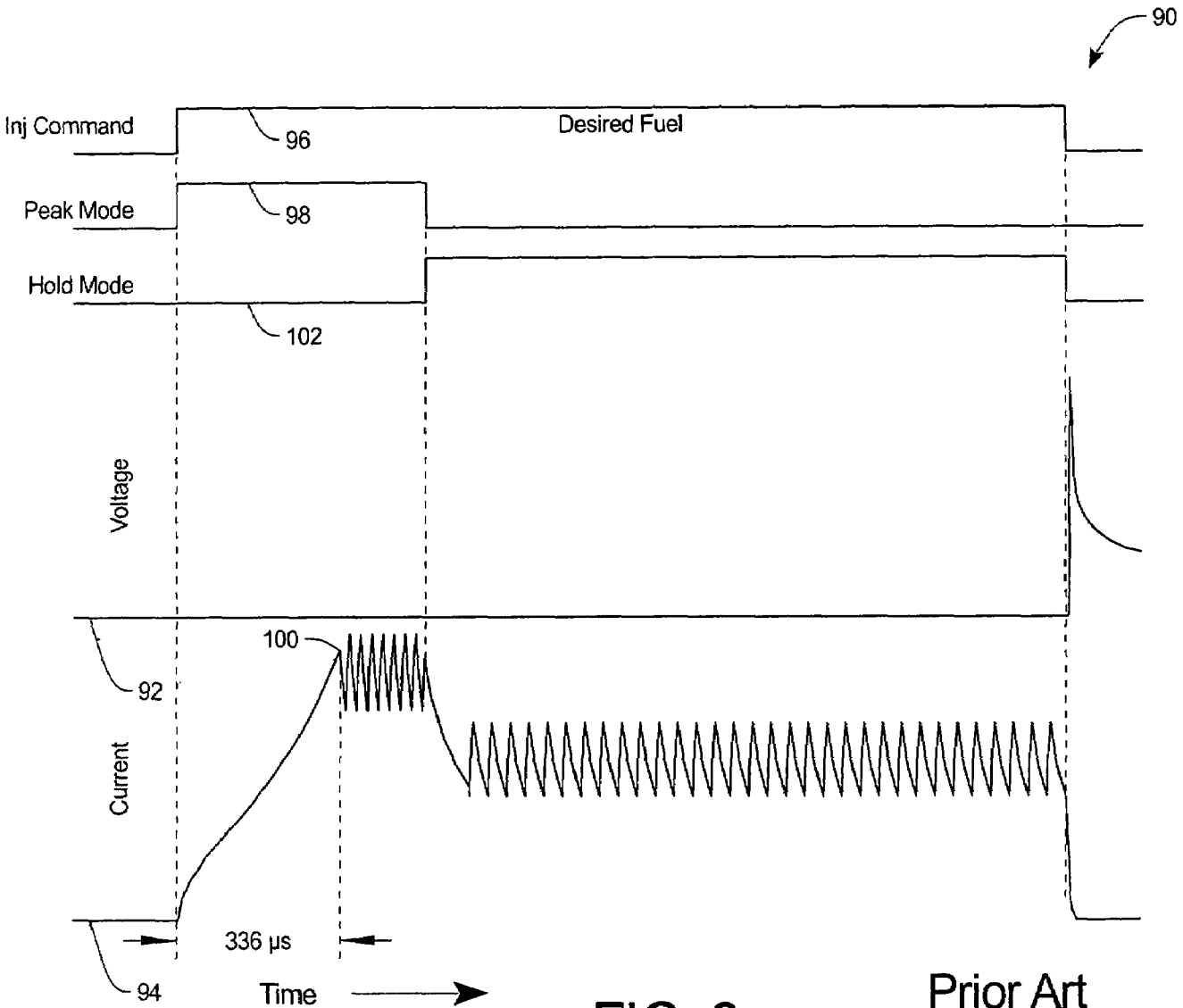
FIG. 2 Prior Art
FIG. 2 is a graphical representation of the voltage at one terminal of an injector and the current through the injector driven by a prior art injector driver.

FIG. 2 is a graphical representation 90 of the voltage 92 at node 32 and the current 94 through the injector 12 driven by a prior art injector driver. As can be seen in FIG. 2, the initiation of an injector command 96 is coincident with the initiation of a peak mode phase 98 and causes the current 94 through the injector 12 to rise to a desired peak current 100 in approximately 330 μs. When the peak mode 98 ends, a hold mode phase 102 begins and stays active until the end of the injector command 96. During the hold mode 102, the injector current 94 is lower than during the peak mode 98, but at a level to hold the armature in the solenoid in the injector 12 in the fuel delivery position after the peak mode 98 operation has caused the injector current 94 to rise high enough to move the solenoid armature into the fuel delivery position.

These waveforms could be produced by the circuit 10 of FIG. 1 by disabling all of the transistors except transistors 22 and 34. Transistor 22 would be selectively enabled to increase the current through the injector 12 and would be disabled to allow the injector 12 current to fall, and transistor 34 would be on throughout the duration of the injector command 96. The current through the injector 12 would be sensed by the current sensing resistor 38 and amplifier 40. When a predetermined peak current is detected, during both the peak mode 98 and the hold mode 102, transistor 22 would be turned off and the current through the injector 12 would be routed through the diode 30 and the transistor 34 to thereby effectively short circuit the terminals of the injector 12. Similarly, when the injector current 94 would have decayed to a predetermined lower current, the transistor 22 would be enabled again.

Figure 3:
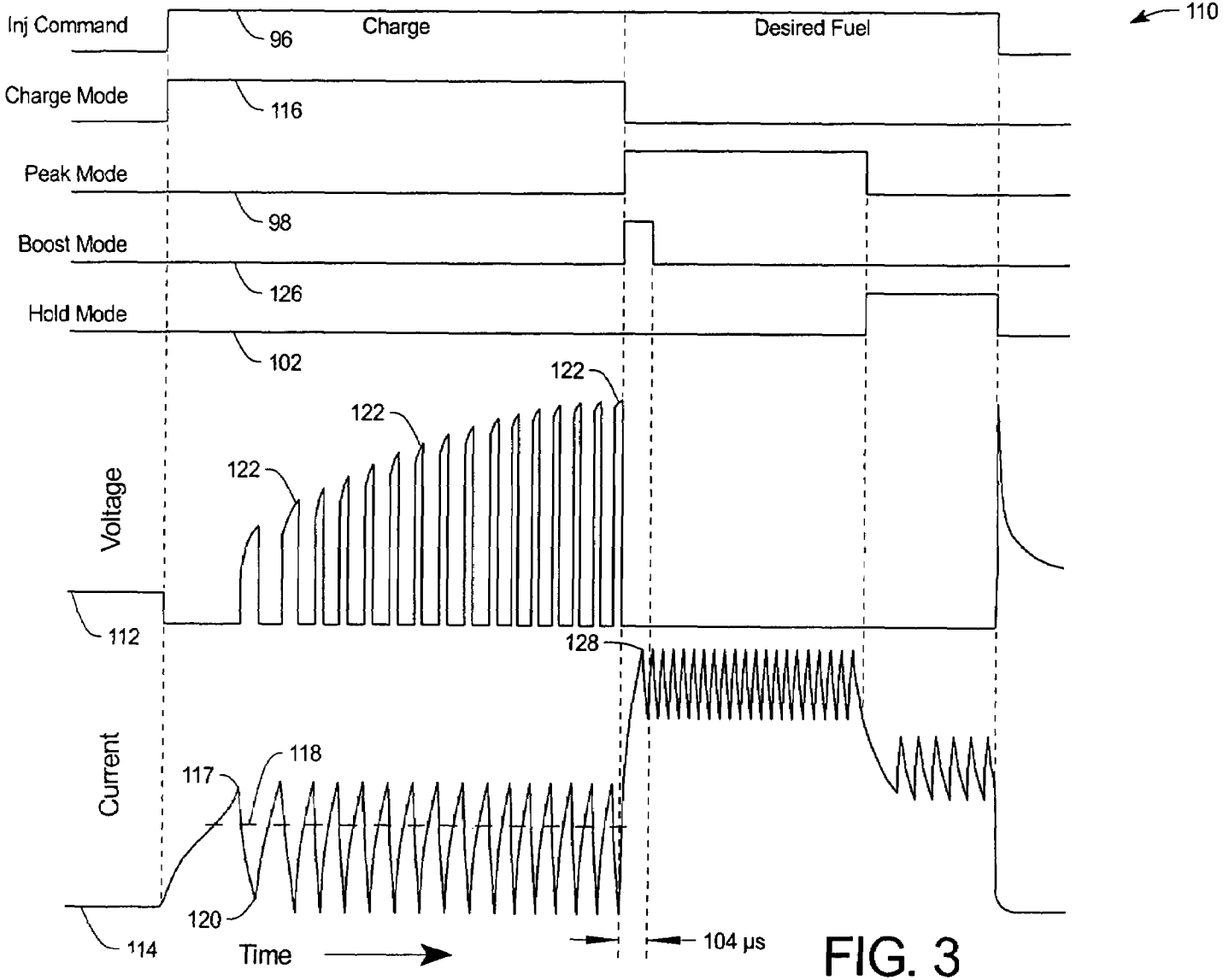
FIG. 3 is a graphical representation of the voltage at one terminal of an injector and the current through the injector using the driver circuit of FIG. 1 in a first method of operation.

FIG. 3 is a graphical representation 110 of the voltage 112 at node 32 and the current 114 through the injector 12 using the driver circuit 10 of FIG. 1 in a first method of operation according to the present invention. In the first method of operation as shown in FIG. 3, at the same time as the initiation of the injector command 96, a charge mode phase 116 is initiated. In the charge mode phase 116, transistors 22 and 54 remain conductive and transistor 34 is initially conductive to allow current to build up in the injector 12. When a pre-determined peak current 117 is detected using the current sensing resistor 38 and voltage amplifier 40, transistor 34 is turned off and the flyback energy from the injector 12 is captured by the storage capacitor 52 with the injector 12 current flowing through the diode 46, storage capacitor 52, transistor 54, and charge current sensing resistor 56. Once the current through the charge current sensing resistor 56 has dropped to a second lower level 120, transistor 34 is turned back on and the cycle is repeated. The RMS current 118 during the charge mode 116 is less than the current necessary to move the pintle or armature in the solenoid of the injector 12. This method essentially uses the injector 12 in a voltage boost mode configuration. The voltage 112 in FIG. 3 is at zero volts when transistor 34 is conductive (when the injector current 114 is increasing) and becomes the voltage level 122, which is a diode drop above the voltage at node 50, when transistor 34 is nonconductive. Zener diode 78 determines the upper limit of the voltage on node 32 to avoid overstressing the transistor 34. This upper limit in the preferred embodiment is about 50 volts. Although the duration of the charge mode 116 is usually set to last a predetermined time, with the peak mode phase 98 and a current boost mode phase 126 beginning at the termination of the charge mode 116, the voltage amplifier 62 can be used to terminate the charge mode operation once a desired voltage at node 50 has been reached. If the charge mode 116 duration is determined by the output of the voltage amplifier 62, the peak mode 98 and boost mode 126 could be delayed in order to deliver fuel to the engine at the proper time.

In the boost mode 126, transistors 22, 34, 54, and 70 are conductive to apply the voltage present at node 50 (approximately 50 volts in the preferred embodiment) across the injector 12. Placing this capacitor voltage across the injector 12 sharply decreases the rise time in the peak mode phase 98 of operation from approximately the 336 μs of FIG. 2 to approximately 104 μs as shown in FIG. 3. At the end of the boost mode 126, which occurs sometime after the peak operating current 128 of the injector 12 has been reached, the transistors 70 and 54 are turned off. The operation of the circuit 10 after the end of the boost mode phase 126 is the same as the operation of the circuit 10 described above with respect to FIG. 2.

Figure 4:
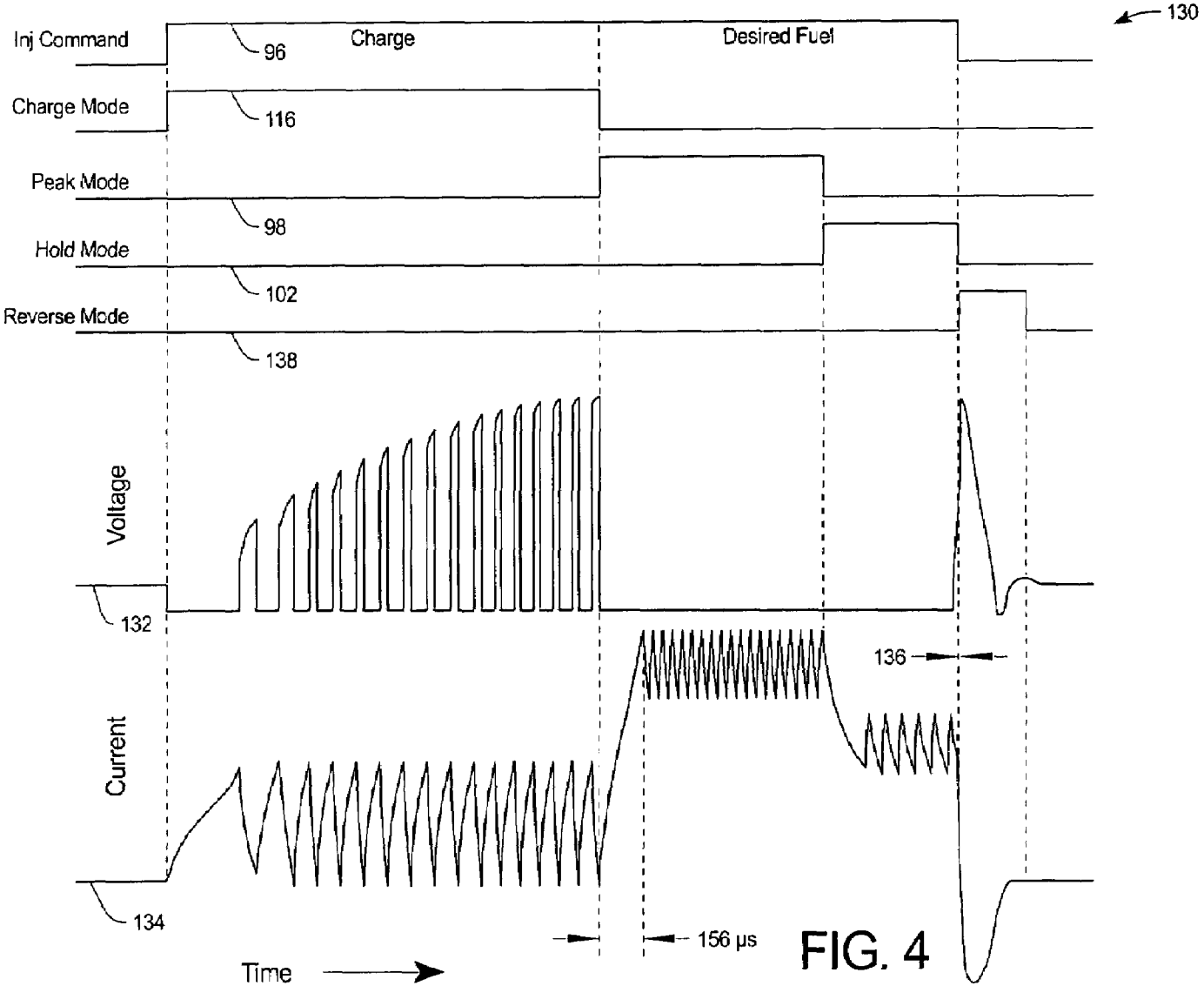
FIG. 4 is a graphical representation of the voltage at one terminal of an injector and the current through the injector using the driver circuit of FIG. 1 in a second method of operation.

FIG. 4 is a graphical representation 130 of the voltage 132 at node 32 and the current 134 through the injector 12 using the driver circuit of FIG. 1 in a second method of operation according to the present invention. The second method differs from the first method of FIG. 3 in that the charge built up on the storage capacitor 52 is not applied to the injector 12 at the beginning of the peak mode 98, but rather the voltage on the storage capacitor 52 is applied shortly after the end of the injector command 96 in a direction to reverse the voltage across the injector 12 and quickly collapse the magnetic field and eddy currents in the injector 12. This results in improved injector closing response. More specifically, the charge mode 116 is the same as described above for FIG. 3, and the peak mode 98 and hold mode 102 are the same as described above for FIG. 2. At the termination of the injector command 96, a delay 136 is provided to allow the injector current 134 to decay to zero amps when the flyback voltage across the injector 12 quickly reduces the injector current 134. At the end of the delay 136, a reverse mode phase 138 begins by enabling transistors 48, 28 and 54 to apply the reverse voltage to the injector 12. The duration of the reverse mode 138 is a predetermined time. The rise time of the injector current 134 is improved from 336 μs of FIG. 2 to 156 μs in FIG. 4 due to the reduction in the eddy currents in the injector 12 during the charge mode 116. This reduction is most beneficial if the peak mode 98 begins at the end of the charge mode 116.

Figure 5:
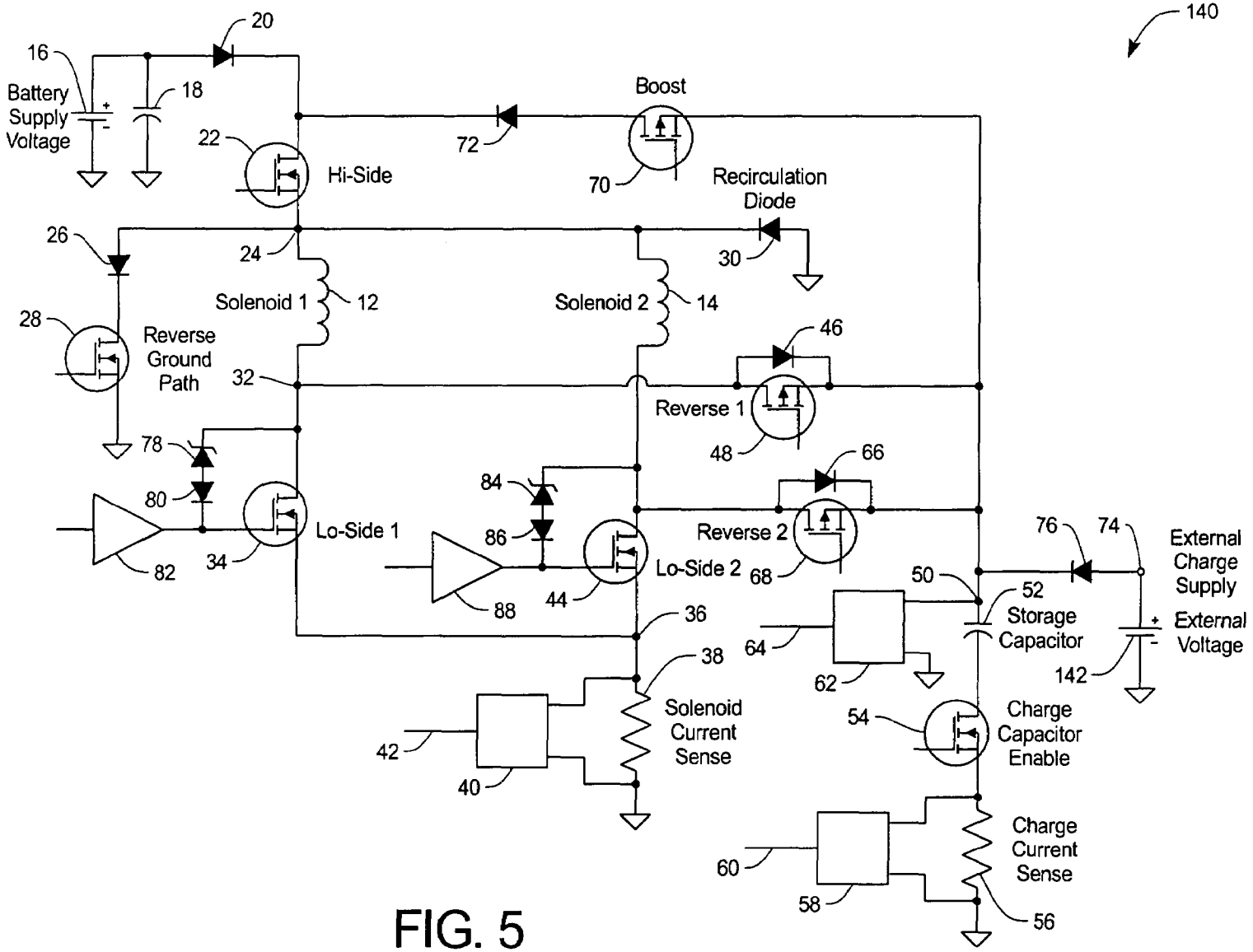
FIG. 5 is a schematic diagram of the circuit of FIG. 1 modified by the addition of an external voltage source.

FIG. 5 is FIG. 1 with the addition of an external voltage supply 142. The external voltage supply 142 is applied to node 50 through the anode-to-cathode junction of a diode 76. The transistor 54 is conductive in this third method of operation and the storage capacitor 52 operates as a voltage stabilizing capacitor.

Figure 6:
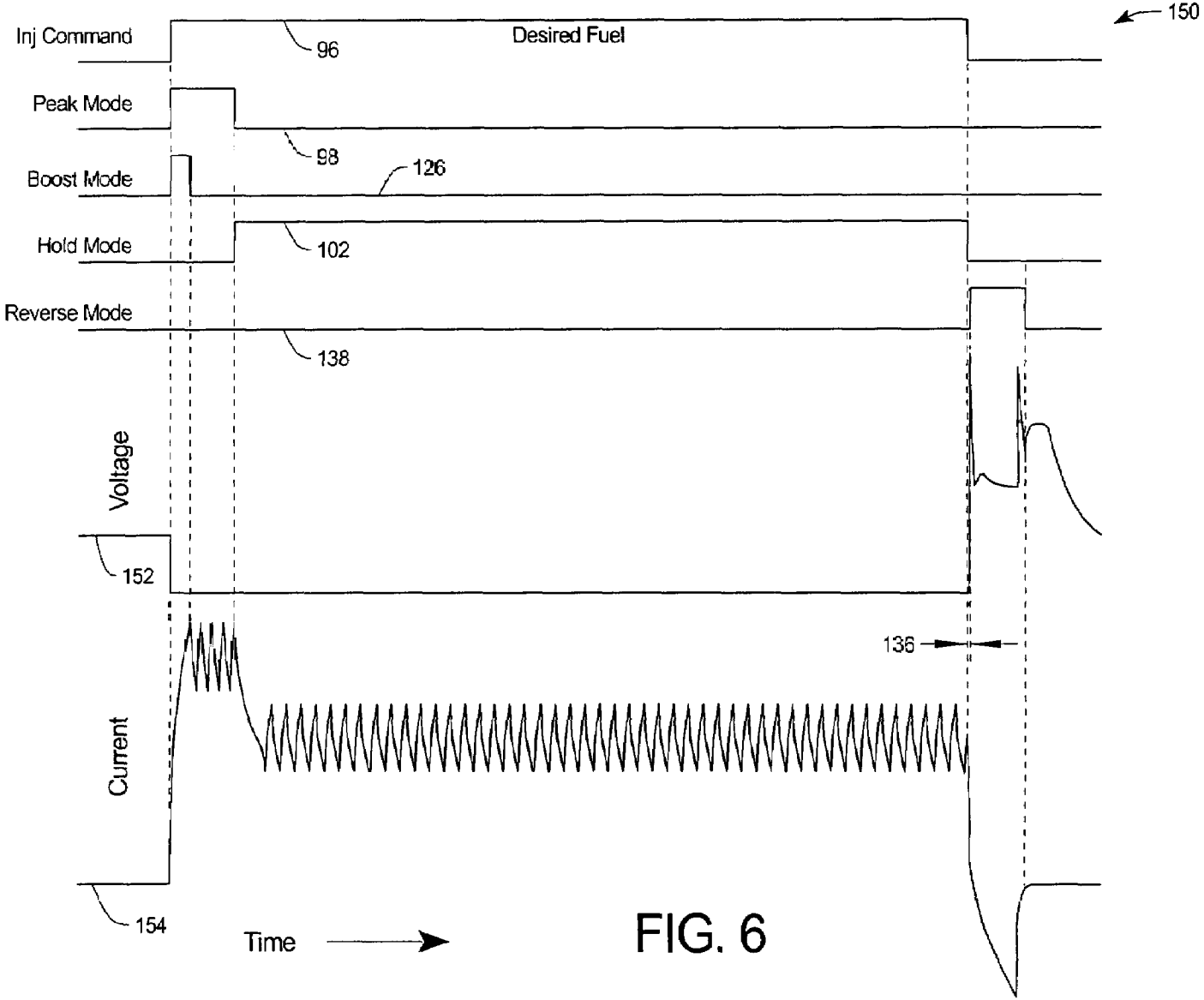
FIG. 6 is a graphical representation of the voltage at one terminal of an injector and the current through the injector using the driver circuit of FIG. 1 in a third method of operation.

FIG. 6 is a graphical representation 150 of the voltage 152 at node 32 and the current 154 through the injector 12 using the driver circuit of FIG. 5 in a third method of operation according to the present invention. In the third method of operation, an external voltage supply 142 is applied to terminal 74. Since the external voltage supply 142 is applied to node 50, there is no need for a charge mode 116, and both the boost mode 126 and reverse mode 138 can be used since external voltage supply 142 does not lose charge as does the storage capacitor 52 when current is drawn from node 50.

Figure 7:
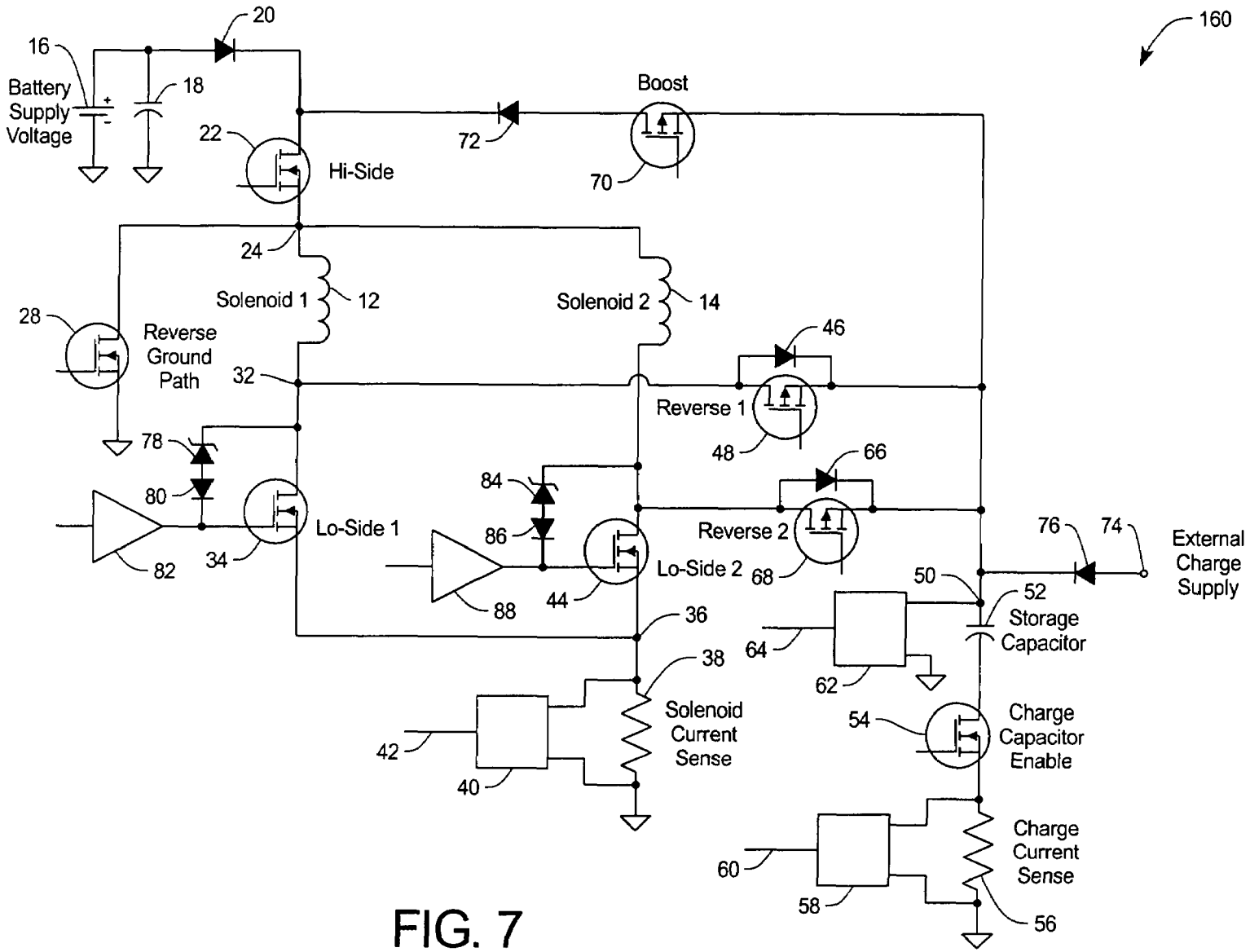
FIG. 7 is the schematic diagram of the circuit of FIG. 1 modified by the removal of two of the diodes.

FIG. 7 is the driver circuit 10 of FIG. 1 with the diodes 26 and 30 removed. The transistor 28 would then be enabled at the appropriate times to provide a current path to chassis ground when either diode 26 or diode 30 were to be conductive in the operation of the driver circuit 10 of FIG. 1.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method of operating a solenoid comprising the steps of:

a) applying a voltage across said solenoid sufficient to cause a current of a first magnitude to flow through said solenoid;

b) stopping the application of said voltage and conducting the flyback energy in said solenoid onto a capacitor to transfer charge to said capacitor until said current through said solenoid is at a second magnitude;

c) reapplying said voltage across said solenoid to cause said current to become said first magnitude while isolating said capacitor such that said charge in said capacitor is essentially maintained;

d) repeating steps b) and c) at least once; and e) applying said charge to said solenoid to cause said current through said solenoid to reach a third magnitude, which is greater than either of the first or the second magnitudes, wherein step d) is repeated such that steps a)-d) and the at least one repetition of step d) occur within a charging mode of said capacitor, wherein said charging mode has a predetermined time duration.

2. A driver circuit for a solenoid comprising:

a) a first voltage source having a first terminal coupled to ground and a second terminal coupled to a first terminal of a first switching device, a second terminal of said first switching device coupled to a first terminal of said solenoid;

b) a second switching device coupled between a second terminal of said solenoid and ground;

c) a third switching device coupled between said second terminal of said solenoid and a first terminal of a capacitor, said capacitor having a second terminal coupled to ground through a fourth switching device;

d) a fifth switching device coupled between ground and said first terminal of said solenoid; and e) a sixth switching device coupled between said first terminal of said capacitor and said first terminal of said first switching device.

3. The driver circuit of claim 2 further including a second voltage source coupled between said first terminal of said capacitor and ground.

4. A driver circuit for a solenoid comprising:

a) a first voltage source having a first terminal coupled to ground and a second terminal coupled to a first terminal of a first switching device, a second terminal of said first switching device coupled to a first terminal of said solenoid;

b) a second switching device coupled between a second terminal of said solenoid and ground;

c) a third switching device coupled between said second terminal of said solenoid and a first terminal of a second voltage source, said second voltage source having a second terminal coupled to ground;

d) a fourth switching device coupled between ground and said first terminal of said solenoid; and e) a fifth switching device coupled between said first terminal of said second voltage source and said first terminal of said first switching device.

* * * * *